US005613910A

United States Patent [19]

Hamano

[11] Patent Number: 5,613,910

[45] Date of Patent: Mar. 25, 1997

[54] TOKEN GAME MACHINE

[75] Inventor: Takashi Hamano, Kawasaki, Japan

[73] Assignee: Konami Co., Ltd., Hyogo-ken, Japan

[21] Appl. No.: 505,980

[22] Filed: Jul. 24, 1995

[30] Foreign Application Priority Data

Jul. 27, 1994 [JP] Japan ..... 6-193844

[51] Int. Cl.[6] ..... A63F 3/00

[52] U.S. Cl. ..... 463/19; 273/121 B; 463/22

[58] Field of Search ..... 273/138 R, 142 E, 273/142 F, 142 G, 271, 121 B, 138 A, 123 R; 463/1, 17, 19, 22, 16

[56] References Cited

FOREIGN PATENT DOCUMENTS 0391667 10/1990 European Pat. Off. .

2183381 6/1987 United Kingdom .

WO8204340 12/1982 WIPO .

*Primary Examiner*—Jessica Harrison

*Attorney, Agent, or Firm*—Jordan and Hamburg

[57] ABSTRACT

A token game machine in which individual tokens are moved along a panel surface includes: a plurality of proximity sensors provided at different locations on the panel surface for detecting tokens passing nearby; a symbol assigner for randomly assigning different symbols to the individual proximity sensors; a symbol data output device for outputting data on a symbol assigned to a proximity sensor that has detected a nearby-passing token; and a game judgment device for judging whether a game has been won based on symbol data outputted from the symbol data output device.

16 Claims, 4 Drawing Sheets

TOKEN GAME MACHINE

BACKGROUND OF THE INVENTION

This invention relates to a token game machine in which individual tokens or coin-like pieces are caused to move along a surface of a panel and a player wins or looses depending on which locations on the panel tokens pass.

Such token game machines are disclosed in Japanese Unexamined Utility Model Publication No. 5-13486, Japanese Unexamined Patent Publication No. 6-71026, for example. According to these Publications, a conventional token game machine is provided with pockets at several locations on a panel to catch tokens or allow them to pass through. If a token dropped along the panel surface falls into or passes through one of those pockets, the machine detects it and illuminates a light at a specific location on a bingo display provided on the panel or causes a roulette wheel to rotate. When a complete row of lights on the bingo display are illuminated, or when the roulette wheel stops to make a particular combination of printed patterns, the machine judges that the player has won and pays off a predefined number of tokens.

According to the above-described construction of the conventional token game machine, each pocket is correlated with a particular location on the bingo display, or with a particular roulette turning command. Therefore, the player could more or less predict the later progress of each game based on which pockets individual tokens go in. This used to make the player feel the game rather monotonous and lose interest in it once he or she has become familiar with the use of the token game machine.

SUMMARY OF THE INVENTION

It is an object of the present invention to provide a token game machine which has overcome the problems residing in the prior art.

It is another object of the present invention to provide a token game machine on which a player can hardly predict the future progress of a game so that the game would be more attractive and enjoyable.

The present invention is directed to a token game machine comprising: a panel along a surface of which tokens are moved; a plurality of proximity sensors provided at different locations on the panel surface for detecting tokens passing nearby, a symbol assigner for randomly assigning different symbols to the individual proximity sensors, a symbol data output device for outputting data on a symbol assigned to such proximity sensor that has detected nearby-passing token, and a game judgment device for judging whether a game has been won based on symbol data outputted from the symbol data output device.

Since the symbol assigner randomly assigns different symbols to the individual proximity sensors, the symbols assigned to the individual proximity sensors do not necessary remain the same. The result is that individual games are not likely to evolve in the same way and it is difficult for the player to predict the progress of games, which in turn serves to provide exciting plays.

The token game machine may be further provided with an end-of-game command device. The symbol assigner alters the symbols assigned to the individual proximity sensors when the end-of-game command device is operated by the player.

With this arrangement, each game can be played with new symbol assignment to the proximity sensors so that the playing on the token game machine becomes more enjoyable.

The token game machine may be further provided with indicators arranged in more than one straight line, the indicators corresponding to the individual symbols assigned by the symbol assigner, and a display for changing indication on an indicator of which symbol data has been outputted from the symbol data output device, wherein the game judgment device judges that a game has been won when indications on all indicators in a straight line have changed.

With this arrangement, the player can visually recognize from the indicators whether he or she is winning with intuitive presentation of current situations. The indicators should preferably be arranged in a matrix form, in which lines of indicators intersect each other with some indicators located at intersecting points. This arrangement will offer a chance of achieving more than one win at a time when data on a particular symbol is outputted so that each play would be even more enjoyable.

The proximity sensors may be arranged in a plurality of separate blocks on the panel surface, and the symbol assigner divides the indicators into a plurality of groups and assigns symbols corresponding to individual indicators in each group to individual proximity sensors within one block.

The individual indicators may be allocated to different groups depending on whether they are located at intersecting points, and the proximity sensors may be divided into corresponding blocks. This arrangement serves to add variety in plays.

The token game machine may be further provided with a plurality of symbol indicators individually located close to the proximity sensors, wherein each symbol indicator indicates a symbol assigned to its nearby proximity sensor.

This arrangement allows the player to easily recognize the symbols assigned to the individual proximity sensors.

The token game machine may be further provided with a calculator for calculating the number of tokens to be paid off based on the result of judgment by the game judgment device, and a token payoff device for paying off the calculated number of tokens when the end-of-game command device is operated by the player, wherein the token payoff device accepts a request for payoff entered from the end-of-game command device after a specified time has elapsed since one of the proximity sensors detected a nearby-passing token.

With this arrangement, it is possible to limit the chance of payoffs to a desired level and provide exciting plays.

These and other objects, features and advantages of the invention will become more apparent upon a reading of the following detailed description of the preferred embodiment with reference to the appended drawings.

DETAILED DESCRIPTION OF THE PREFERRED EMBODIMENT OF THE INVENTION

Figure 1:
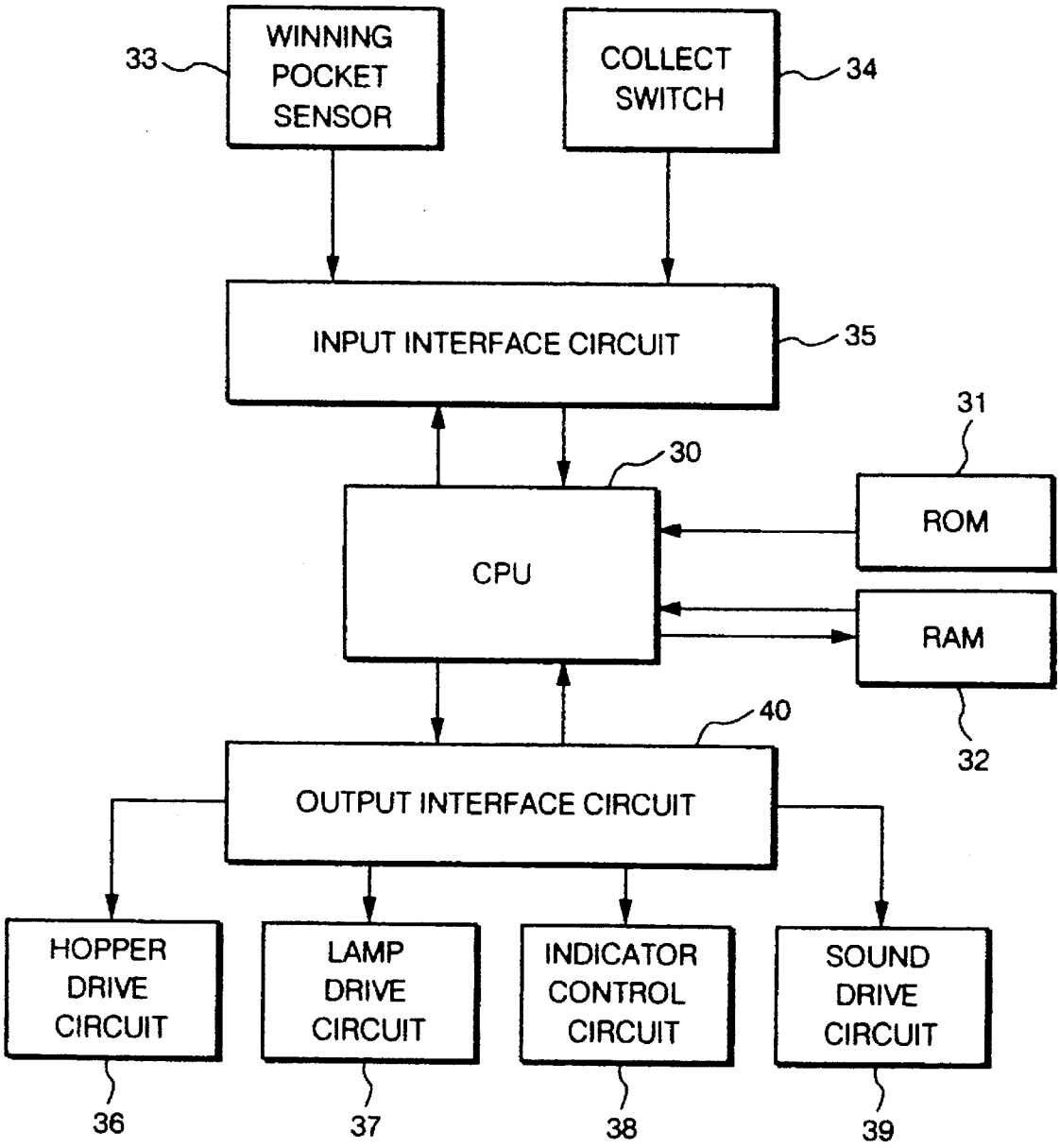
FIG. 1 is a block diagram showing a circuit configuration of a token game machine of the present invention.
Figure 2:
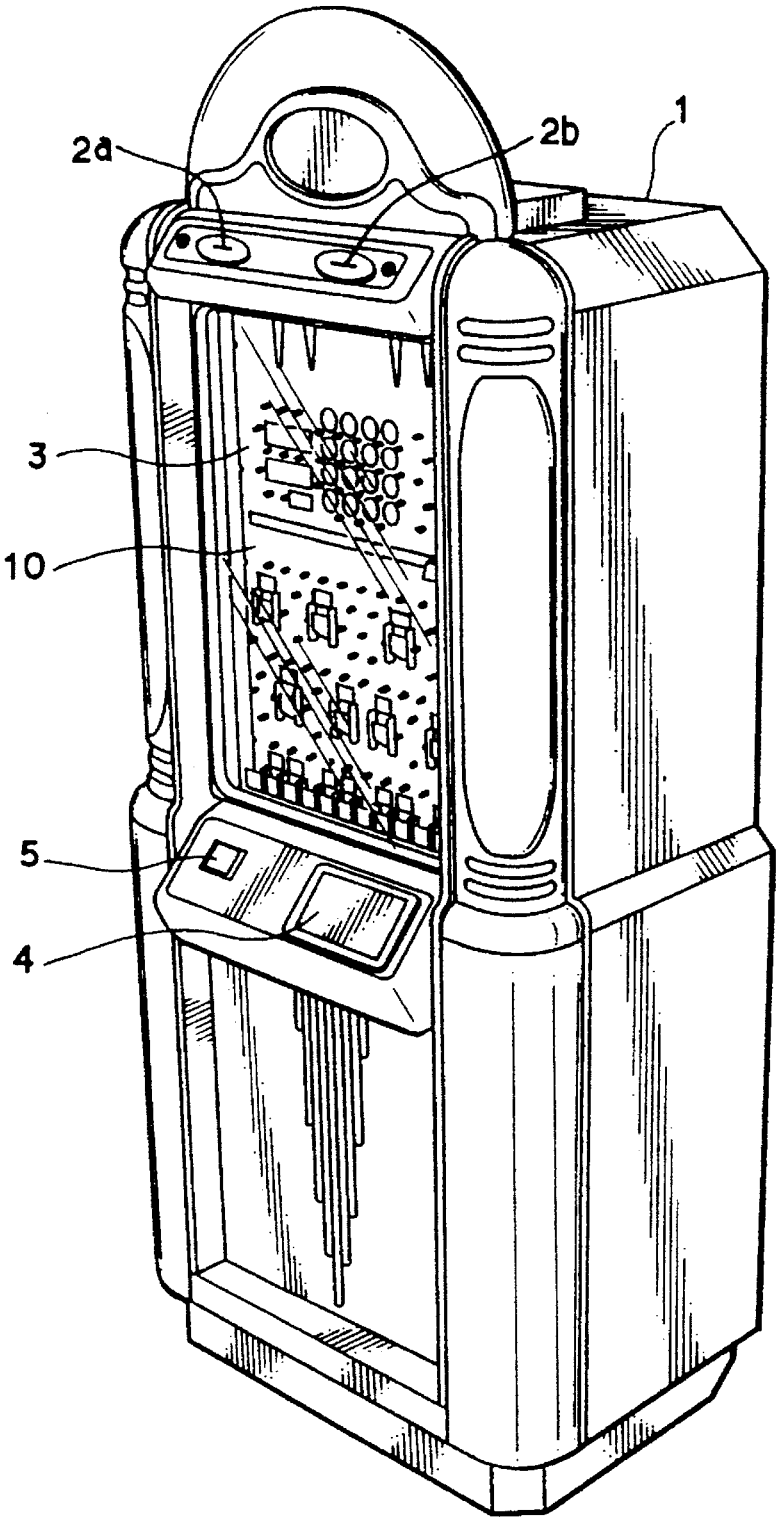
FIG. 2 is a perspective view showing a general construction of the token game machine.

FIG. 1 is a block diagram showing a circuit configuration of a token game machine 1 presented as one embodiment of the present invention; FIG. 2 is a perspective view showing a general construction of the token game machine 1; and FIG. 3 is an elevational view showing a panel 10 of the token game machine 1.

Referring first to FIG. 2, there are provided at an upper front portion of the token game machine 1 a pair of token slots 2*a*–2*b* into which a player inserts tokens. A token inserted into one of these slots 2*a*–2*b* falls through the gap between the panel 10 vertically mounted on the front side of the token game machine i and a plate glass 3 covering the front of the panel 10. The token finally drops into a winning pocket or an ending pocket, which will be explained later, and is led to the rear side of the panel 10. Indicated at the numeral 4 is a token return in which tokens paid off from an unillustrated hopper are held. Indicated at the numeral 5 is a collect button for requesting the token game machine 1 to pay off tokens.

Figure 3:
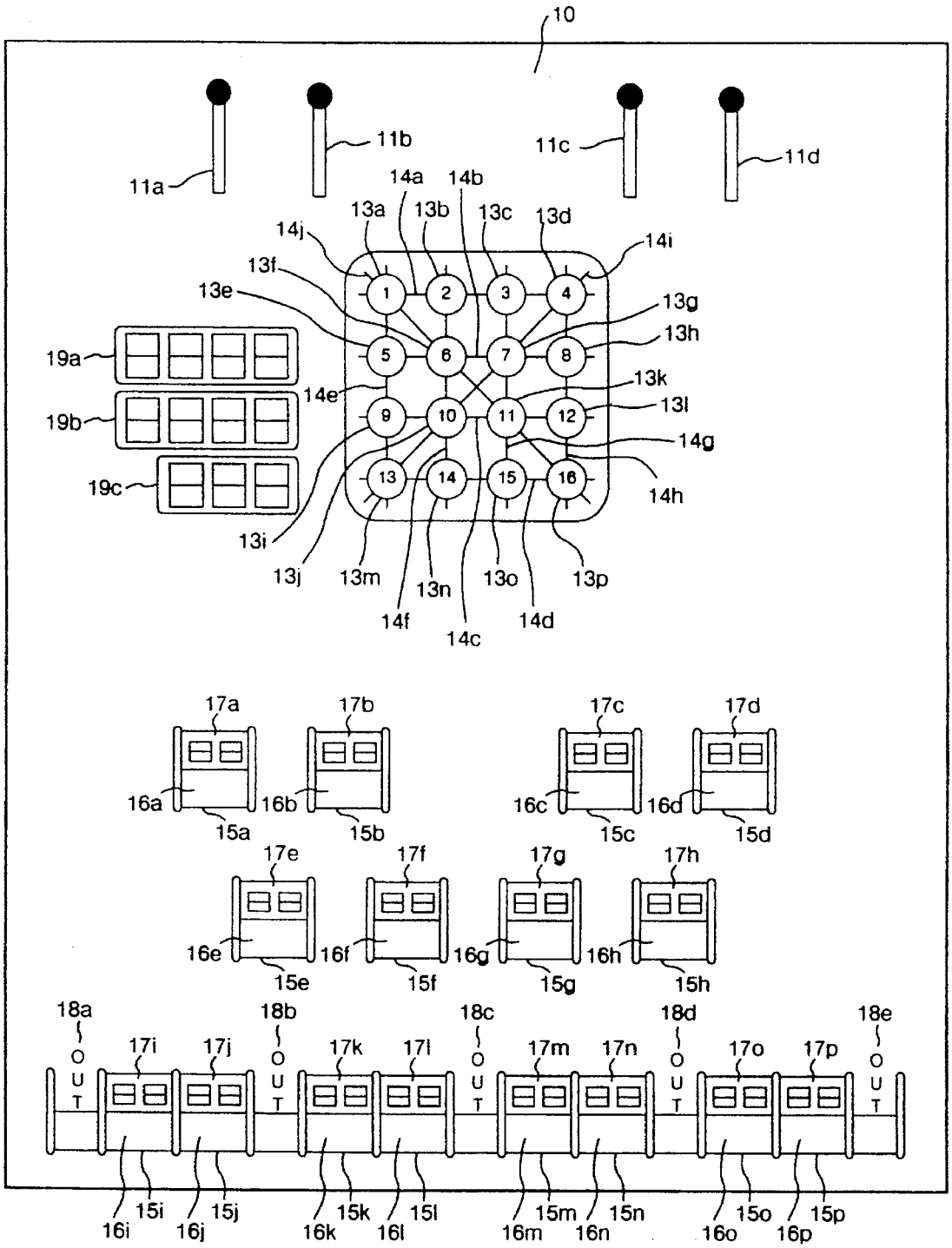
FIG. 3 is an elevational view showing a panel of the token game machine.

Referring next to FIG. 3, provided at the top of the panel 10 are flippers 11*a*–11*d*, each mounted swingingly about its one end, for flipping tokens entered through the token slots 2*a*–2*b*. While the token game machine 1 is operated, the flippers 11*a*–11*d* are swung by an unillustrated swing mechanism. Therefore, individual tokens falling from the top of the panel 10 are flipped to the right or left as they hit against the swinging flippers 11*a*–11*d*. According to the present embodiment, the left-hand pair of flippers 11*a*–11*b* and right-hand pair of flippers 11*c* –11*d* have different swinging periods so that both pairs would interfere with each other resulting in an increased variation in flipping operation.

Located below the flippers 11*a*–11*d* is a bingo display 12 on which the same number of numeric indicators 13*a*–13*p* as later-described winning pockets 15*a*–15*p* are provided. In this embodiment, there are provided sixteen winning pockets 15*a*–15*p* the numeric indicators 13*a*–13*p*, and the numeric indicators 13*a*–13*p* are numbered 1 through 16 in this order As shown in FIG. 3, the sixteen numeric indicators 13*a*–13*p* are arranged in a matrix of four rows by four columns. In addition, there are provided winning line indicators 14*a*–14*j*, each showing a row, column or diagonal of the matrix. The numeric indicators 13*a*–13*p* and winning line indicators 14*a*–14*j* individually incorporate illuminating lamps. The numeric indicators 13*a*–13*p* light when tokens pass through the respective winning pockets 15*a*–15*p*. The winning line indicator 14 *a*, 14*b*, . . . or 14*j* lights when four numeric indicators in a row, column or diagonal are all lit. A detailed explanation of these indicators will be provided later.

The winning pockets 15*a*–15*p* are provided roughly on the lower half of the panel 10. Each of the winning pockets 15*a*–15*p* has an unillustrated through hole cut out in the panel 10 as well as a guide member 16*a*, 16*b*, . . . or 16*p* covering the front side the through hole. If a token dropped from the top of the panel 10 goes behind one of the guide members 16*a*–16*p*, the token is guided to the through hole and right into an unillustrated shooter which is provided on the back of the panel 10. Individual tokens that have been guided to the shooter are then temporarily stored in an unillustrated token box, and a specified number of tokens are paid off from the unillustrated hopper upon a winning judgment as will be described later.

Each of the winning pockets 15*a*–15*p* is provided with a winning pocket sensor (unillustrated in FIG. 3) for detecting a passage of a token. The winning pocket sensor may utilize, for example, a proximity sensor, a metal detecting sensor, or an appropriate mechanical contact switch such as a microswitch.

Just above the individual winning pockets 15*a*–15*p*, there are provided winning number indicators 17*a*–17*p*. Each of the winning number indicators 17*a*–17*p* comprises, for example, a two-digit segment-type light emitting diode (hereinafter referred to as LED) display which randomly shows the numbers 1 to 16 in such a manner that different winning number indicators 17*a*–17*p* do not show the same number at a time. A later discussion will deal with assignment of numbers to be displayed on the individual winning number indicators 17*a*–17*p*.

According to the embodiment depicted in FIG. 3, the sixteen winning pockets 15*a*–15*p* are arranged in three separate arrays. Specifically, four winning pockets 15*a*–15*d* horizontally arranged at the approximate center of the panel 10 constitute an upper array; another four winning pockets 15*e*–15*h* horizontally arranged below the upper array constitute a middle array; and the remaining eight winning pockets 15*i*–15*p* horizontally arranged along the bottom edge of the panel 10 constitute a lower array. Within the lower array of the winning pockets 15*i*–15*p*, there are also provided five ending pockets 18*a*–18*e*. Detailed description of the ending pockets 18*a*–18*e* is omitted since they have substantially the same construction as the winning pockets 15*a*–15*p* except that the former are not provided with the winning number indicators 17*a*–17*p*.

In FIG. 3, indicated at the numeral 19*a* is a payoff indicator for indicating the number of tokens gained by the player; indicated at the numeral 19*b* is an input indicator for indicating the number of tokens inserted into the token slots 2*a*–2*b*; and indicated at the numeral 19*c* is an odds indicator for indicating a current value of odds. Each of these indicators 19*a*–19*c* includes, for example, a segment-type LED display capable of showing more than one digit.

Referring now to FIG. 1, the token game machine 1 comprises a central processing unit (hereinafter referred to as CPU) 30, a read-only memory (hereinafter referred to as ROM) 31 which stores a control program including an overall control procedure used for the present embodiment, and a random access memory (hereinafter referred to as RAM) 32 for temporarily holding control parameters and other data. Indicated at the numeral 33 is the earlier mentioned winning pocket sensor provided at each of the winning pockets 15*a*–15*p* and ending pockets 18*a*–18*d*, and indicated at the numeral 34 is a collect switch which becomes ON when the collect button 5 of FIG. 1 is pressed by the player. Outputs from the winning pocket sensors 33 and collect switch 34 are delivered to the CPU 30 via an input interface circuit 35.

The token game machine 1 further comprises a hopper drive circuit 36 for driving the hopper to pay off tokens, a lamp drive circuit 37 for driving the lamps in the bingo display 12, an indicator control circuit 38 for controlling digital readouts on the winning number indicators 17*a*–17*p*, payoff indicator 19*a*, input indicator 19*b* and odds indicator 19*c*, and a sound drive circuit 39 for producing a background music or other form of sound at appropriate moments in the course of a game. The hopper drive circuit 36, lamp drive circuit 37, indicator control circuit 38 and sound drive circuit 39 are individually controlled by control signals transmitted from the CPU 30 via an output interface circuit 40.

Operations of the token game machine 1 is now described with reference to FIGS. 1–3 and the flowchart shown in FIG. 4.

Figure 4:
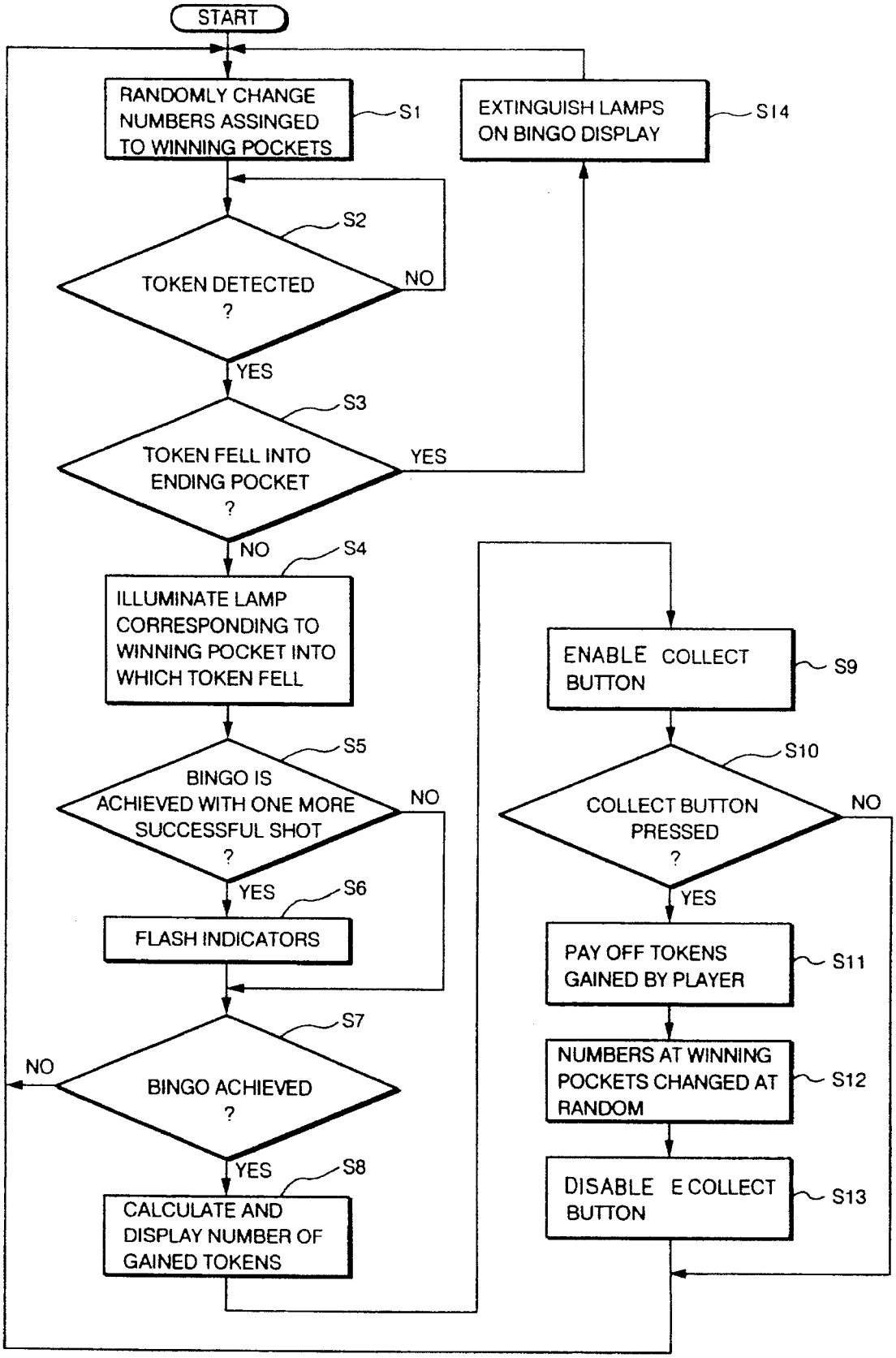
FIG. 4 is a flowchart showing an operation sequence of the token game machine.

FIG. 4 shows an operating sequence of the token game machine 1 which begins when it is turned on. In Step S1, the CPU 30 generates random numbers and determines numbers (1 to 16) to be assigned to the individual winning number indicators 17*a*–17*p*. Signals for setting the assigned number are delivered to the indicator control circuit 38 by way of the input interface way circuit 35 and output interface circuit 40. The indicator control circuit 38 sets the assigned numbers (1 to 16) for the individual winning number indicators 17*a*–17*p* based on these signals.

Numbers to be assigned to the individual winning number indicators 17*a*–17*p* may be determined completely at random. In the present embodiment, however, the winning pocket indicators 17*a*–17*d* of the upper-array winning pockets 15*a*–15*d* are randomly assigned with the numbers 6, 7, 10 and 11 which are marked on the four numeric indicators 13*f*, 13*g*, 13*j*, 13*k* at the central portion of the bingo display 12. Similarly, the winning pocket indicators 17*e*–17*h* of the middle-array winning pockets 15*e*–15*h* are randomly assigned with the numbers 1, 4, 13 and 16 which are marked on the four numeric indicators 13*a*, 13*d*, 13*m*, 13*p* at the four corners of the bingo display 12; and the winning pocket indicators 17*i*–17*p* of the lower-array winning pockets 15*i*–15*p* are randomly assigned with the remaining numbers 2, 3, 5, 8, 9, 12, 14 and 15.

In Step S2, the CPU 30 waits for a token detect signal which is outputted when any of the winning pocket sensors 33 detects a token. Upon receiving the token detect signal, the CPU 30 checks whether the token fell into any of the ending pockets 18*a*–18*d* in Step S3. If it is found that the token fell into one of the ending pockets 18*a*–18*d*, the operation flow advances to Step S14, where the CPU 30 sends a command signal for extinguishing all the lamps on the bingo display 12 to the lamp drive circuit 37 via the input interface circuit 35 and output interface circuit 40. Upon receiving this command signal, the lamp drive circuit 37 extinguishes all the lamps on the bingo display 12, and at this point the operation flow returns to Step S1. If it is found in Step S3 that the token did not fall into any of the ending pockets 18*a*–18*d*, that is, the token fell into one of the winning pockets 15*a*–15*p*, the operation flow proceeds to Step S4.

In Step S4, the CPU 30 identifies the winning pocket 15*a*, 15*b*, . . . or 15*p* into which the token fell. Then, the CPU 30 produces a command signal for illuminating the lamp on the numeric indicator 13*a*, 13*b*, . . . or 13*p* that carries the same number as displayed on the winning number indicator 17*a*, 17*b*, . . . or 17*p* at the identified winning pocket 15*a*, 15*b*, . . . or 15*p*. This command signal is sent to the lamp drive circuit 37 via the input interface circuit 35 and output interface circuit 40. Upon receiving this command signal, the lamp drive circuit 37 turns on the lamp in the specified numeric indicator 13*a*, 13*b*, . . . or 13*p*.

In Step S5, the CPU 30 judges whether three of the numeric indicators 13*a*–13*p* in the same row, column or diagonal are already lit, i.e., "Bingo" can be achieved with one more successful shot. If the judgment result is in the affirmative, the operation flow proceeds to Step S6, where the CPU 30 produces a command signal for flashing the numeric indicator 13*a*, 13*b*, . . . or 13*p* with which "Bingo" is completed as well as another command signal for flashing the winning number indicator 17*a*, 17*b*, . . . or 17*p* at the winning pocket 15*a*, 15*b*, . . . or 15*p* into which a token should fall to accomplish "Bingo." These command signals are respectively sent to the lamp drive circuit 37 and indicator control circuit 38 via the input interface circuit 35 and output interface circuit 40. Upon receiving the respective command signals, the lamp drive circuit 37 flashes the lamp in the specified numeric indicator 13*a*, 13*b*, . . . or 13*p* while the indicator control circuit 38 flashes the specified winning number indicator 17*a*, 17*b*, . . . or 17*p*. If the judgment result in Step S5 in the negative, the operation flow advances to Step S7.

In Step S7, the CPU 30 examines ON/OFF status of the numeric indicators 13*a*–13*p* to judge whether "Bingo" is already achieved. If the judgment result is in the affirmative, the operation flow proceeds to Step S8. If the judgment result is in the negative, the operation flow returns to Step S2. In Step S8, the CPU 30 calculates the number of tokens gained by "Bingo" and causes the indicator control circuit 38 to show that number on the payoff indicator 19*a*. The CPU 30 also causes the lamp drive circuit 37 to illuminate one of the winning line indicators 14*a*–14*j* corresponding to the row, column or diagonal on which "Bingo" has been achieved. Furthermore, the CPU 30 causes the sound drive circuit 39 to produce a background music or other form of sound indicating an achievement of "Bingo."

Calculation of the number of tokens to be paid off to the player may be made in any arbitrary manner. As an example, when "Bingo" has been achieved in just a single line, the payoff may be ten tokens, which would be doubled thereafter each time "Bingo" is achieved in one line after another; thus, the payoff would increase from ten tokens to twenty tokens, forty tokens and so on. Alternatively, the payoff may be increased by ten tokens each time "Bingo" is achieved; thus, the payoff would increase from ten tokens to twenty tokens, thirty tokens and so on in this case.

Proceeding to Step S9, the collect button 5 is enabled so that the player can enter a request for payoff. There may be provided in the vicinity of the collect button 5 a lamp which will light only when payoff operation is enabled so that the player can recognize it. In Step S10, the CPU 30 examines ON/OFF status of the collect switch 34 to judge whether the player has pressed the collect button 5. If the judgment result is in the affirmative, the operation flow proceeds to Step S11. If the judgment result is in the negative, the operation flow returns to Step S2.

In Step S11, the CPU 30 causes the hopper drive circuit 36 to drive the hopper so that it will release that number of tokens which was calculated in Step S8 into the token return 4. In Step S12, numbers shown on the winning number indicators 17*a*–17*p* are changed at random in the same manner as Step 1. In Step S13, the collect button 5 is disabled so that player's requests for payoff would be rejected.

Numbers shown on the winning number indicators 17*a*–17*p* are changed at random at the beginning of a game and when tokens have just been paid off. Consequently, numbers assigned to the individual winning pockets 15*a*–15*p* vary at random each time the player begins a new round of play so that individual games are not likely to evolve in the same way. This makes it difficult for the player to predict the later progress of each game and, thus, allows the player to enjoy an exciting game.

When "Bingo" is achieved, the collect button 5 is enabled to allow payoff of tokens after a specified time (which corresponds to the time required for execution of Steps S3 through S9 of FIG. 4) has elapsed since a winning pocket sensor 33 detected a token. If the collect button 5 is always usable for receiving payoffs, the player can receive the gained number of tokens at any time only if he or she enters a request for payoff just before a token falls into one of the ending pockets 18*a*–18*d*. If this is possible, there is no sense in canceling a state of "Bingo" with a token falling into an ending pocket 18*a*, 18*b*, . . . or 18*d*. On the other hand, if the player is entitled to receive payoffs only when "Bingo" has just been achieved in a new line of numbers, there would be very little chance for the player to gain tokens and it would be impossible to provide an attractive game. As already described, the token game machine 1 allows the player to receive tokens by operating the collect button 5 after a specified time has elapsed since a token fell into a winning pocket 15*a*, 15*b*, . . . or 15*p*. With this arrangement, it is possible to limit the chance of receiving payoffs to a desired level and provide an attractive game.

Although a particular embodiment has so far been described, it is to be understood that the invention is not precisely limited thereto and that various modifications may be made without departing from the spirit or scope of the invention. For example, although the numbers 1 to 16 are individually assigned to the numeric indicators 13*a*–13*p* and winning number indicators 17*a*–17*p* in the foregoing embodiment, different pictorial symbols and marks may be assigned to them. Furthermore, although the numbers assigned to the winning number indicators 17*a*–17*p* are changed each time the collect button 5 is pressed, that is, when an "end-of-game" command is entered in the above embodiment, there may be provided another button by which a player can choose to maintain the current assignment of numbers even when the collect button 5 is pressed.

What is claimed is:

1. A token game machine comprising:

a panel along a surface of which tokens are moved;

a plurality of proximity sensors provided at different locations on the panel surface for detecting tokens passing nearby;

a symbol assignor for randomly assigning an individual symbol to the individual proximity sensors;

a symbol data output device for outputting data on an identification of the symbol assigned to a proximity sensor that has detected a nearby-passing token;

a game judgment device for judging whether a game has been won based on symbol data outputted from the symbol data output device; and an end-of-game command device, wherein the symbol assignor alters the assignation of the symbols assigned to the proximity sensors when the end-of-game command device is operated by the player.

2. A token game machine according to claim 1 further comprising:

indicators arranged in more than one straight line, the indicators corresponding to the individual symbols assigned by the symbol assigner; and a display for changing indication on an indicator of which symbol data has been outputted from the symbol data output device;

wherein the game judgment device judges that a game has been won when indications on all indicators in a straight line have changed.

3. A token game machine according to claim 2, wherein the indicators are arranged in matrix form.

4. A token game machine according to claim 2, wherein the proximity sensors are arranged in a plurality of separate blocks on the panel surface, and the symbol assigner divides the indicators into a plurality of groups and assigns symbols corresponding to individual indicators in each group to individual proximity sensors within one block.

5. A token game machine according to claim 1 further comprising a plurality of symbol indicators individually located close to the proximity sensors for indicating a symbol assigned to its nearby proximity sensor.

6. A token game machine according to claim 1 further comprising:

a calculator for calculating the number of tokens to be paid off based on the result of judgment by the game judgment device; and a token payoff device for paying off the calculated number of tokens when the end-of-game command device is operated by the player, the token payoff device accepting a request for payoff entered from the end-of-game command device after a specified time has elapsed since one of the proximity sensors detected a nearby-passing token.

7. A token game machine comprising:

a panel along a surface of which tokens are moved;

a plurality of proximity sensors provided at different locations on the panel surface for detecting tokens passing nearby;

a symbol assignor for randomly assigning individual symbols to the individual proximity sensors such that none of the proximity sensors share the same symbol;

a symbol data output device for outputting data on an identification of the symbol assigned to a proximity sensor that has detected a nearby-passing token;

a game judgment device for judging whether a game has been won based on symbol data outputted from the symbol data output device.

8. A token game machine according to claim 7 further comprising an end-of-game command device, wherein the symbol assignor alters the assignation of the symbols assigned to the proximity sensors when the end-of-game command device is operated by the player.

9. A token game machine according to claim 8 further comprising:

indicators arranged in more than one straight line, the indicators corresponding to the individual symbols assigned by the symbol assignor; and a display for changing indication on an indicator of which symbol data has been outputted from the symbol data output device;

wherein the game judgment device judges that a game has been won when indications on all indicators in a straight line have changed.

10. A token game machine according to claim 9, wherein the indicators are arranged in matrix form.

11. A token game machine according to claim 9, wherein the proximity sensors are arranged in a plurality of separate blocks on the panel surface, and the symbol assignor divides the indicators into a plurality of groups and assigns symbols corresponding to individual indicators in each group to individual proximity sensors within one block.

12. A token game machine according to claim 8 further comprising a plurality of symbol indicators individually located close to the proximity sensors for indicating a symbol assigned to its nearby proximity sensor.

13. A token game machine according to claim 8 further comprising:

a calculator for calculating the number of tokens to be paid off based on the result of judgment by the game judgment device; and a token payoff device for paying off the calculated number of tokens when the end-of-game command device is operated by the player, the token payoff device accepting a request for payoff entered from the end-of-game command device after a specified time has elapsed since one of the proximity sensors detected a nearby-passing token.

14. A token bingo game machine comprising:

a panel along a surface of which tokens are moved;

a plurality of proximity sensors provided at different locations on the panel surface for detecting tokens passing nearby;

a symbol assignor for randomly assigning individual symbols to the individual proximity sensors;

a symbol data output device for outputting data on an identification of the symbol assigned to a proximity sensor that has detected a nearby-passing token;

indicators arranged in more than one straight line, said indicators corresponding to the individual symbols assigned by the symbol assignor;

a display receiving said outputting data from said symbol data output device, said display changing the indication on an indicator according to which symbol identification data has been outputted from the symbol data output device to the display;

and a game judgment device for judging whether a game has been won when the indications on all indicators in a straight line have changed.

15. A token bingo game machine comprising:

a panel along a surface of which tokens are moved;

a plurality of proximity sensors provided at different locations on the panel surface for detecting tokens passing nearby;

each of said proximity sensors being represented by an individual symbol;

a symbol data output device for outputting data on an identification of the symbol representing a proximity sensor that has detected a nearby-passing token;

indicators arranged in more than one straight line, said indicators corresponding to the individual symbols representing a proximity sensor;

a display receiving said outputting data from said symbol data output device, said display changing the indication on an indicator according to which symbol identification data has been outputted from the symbol data output device to the display; and a game judgment device for judging whether a game has been won when the indications on all indicators in a straight line have changed.

16. A token game machine comprising:

a panel along a surface of which tokens are moved;

a plurality of proximity sensors provided at different locations on the panel surface for detecting tokens passing nearby;

each of said proximity sensors being represented by an individual symbol;

a symbol data output device for outputting data on an identification of the symbol representing a proximity sensor that has detected a nearby-passing token;

indicators arranged in a plurality of winning paths, said indicators corresponding to the individual symbols representing a proximity sensor;

a display receiving said outputting data from said symbol data output device, said display changing the indication on an indicator according to which symbol identification data has been outputted from the symbol data output device to the display; and a game judgment device for judging that a game has been won when the indications on all indicators in a path have changed.

* * * * *